United States Patent [19]

Hadsell et al.

[11] 4,248,264

[45] Feb. 3, 1981

[54] INTERNAL MUD SAVER VALVE

[75] Inventors: William R. Hadsell; Tosh Miyagishima, both of Los Angeles, Calif.

[73] Assignee: Hydril Company, Los Angeles, Calif.

[21] Appl. No.: 108,368

[22] Filed: Dec. 31, 1979

[51] Int. Cl.[3] ..... F16K 25/00

[52] U.S. Cl. ..... 137/454.2; 137/493; 137/508; 137/515

[58] Field of Search ..... 137/454.2, 493, 508, 137/515

[56] References Cited

U.S. PATENT DOCUMENTS

| | | | |
|---|---|---|---|
| 2,447,842 | 8/1948 | Cameron | 137/515 X |
| 2,841,171 | 7/1958 | Baker | 137/493 |
| 3,016,914 | 1/1962 | Keithahn | 137/515 |
| 4,128,108 | 12/1978 | Parker | 137/508 X |

*Primary Examiner*—Harold W. Weakley

*Attorney, Agent, or Firm*—Pravel, Gambrell, Hewitt, Kirk, Kimball & Dodge

[57] ABSTRACT

A valve assembly for preventing a column of drilling fluid from spilling out of the lower end of a kelly includes an elongated body which has an axial opening and is threaded at both ends. A cam is rigidly mounted in the bore and a hollow piston in the opening is mounted for axial movement relative to the cam, the piston being shaped so that fluid pressure in the body will exert a downward force on the piston. A valve element is pivotally mounted in the piston (the piston inner surface defining a valve seat) and movable between a lower-closed position when the valve element is above the cam and engages the seat to an upper-open position where the cam engages the valve element and holds it away from the seat. A spring urges the valve element toward the closed position and the piston is urged upwardly in the bore so that the valve element is normally in its closed position. When a sufficient downward force caused by fluid pressure in the body is applied to the piston to overcome the upward force against the piston, the piston will move down causing the cam to engage and raise the valve element to its open position, the piston moving upwardly and the valve element returning to its closed position when the downward force is removed.

9 Claims, 2 Drawing Figures

INTERNAL MUD SAVER VALVE

TECHNICAL FIELD

This invention relates to an internal drilling fluid control valve and more particularly, a valve located between the kelly and drill string which operates to prevent drilling fluid or mud in the kelly from spilling onto the rig floor during break out and make-up of a drill string tool joint.

A valve is normally provided below the lower kelly valve or in a modified saver sub-assembly for holding the column of mud in the kelly and preventing it from spilling onto the floor of the drilling rig during disengagement and make-up of a drill string tool joint. Such a valve can also be designed to vent a pressure buildup from below after the mud supply pressure is cut off to prevent mud from spilling when the kelly and mud saver valve are disconnected from the drill string. This will conserve the expensive mud and prevent dangerous working conditions from occuring since the mud makes the floor extremely slippery.

A ball and poppet valve has successfully been used to perform these functions, but the location and shape of the internal components of such a valve have been known to require a relatively small bore which results in a pressure drop across the valve. Further, the ball element in such a valve is directly exposed to the abrasive, circulating mud which causes undue erosion and wear of the element. Further, once the ball element is closed a pressure buildup beneath it cannot be vented since only a pressure increase from above the valve will operate automatically to open it.

BACKGROUND ART

U.S. Pat. No. 3,743,015, which is owned by the same corporate entity which owns the subject invention, describes and claims a mud saver ball valve of the type discussed above. The teachings of this patent are totally incorporated by reference as if fully described herein. A normally closed ball element is rotated open by a piston which moves responsive to increased fluid pressure above the element and overcomes the force of one or more springs which hold the ball element closed. If when the mud supply pressure is cut off the pressure within the drill string is still abnormally high the valve will not close since the piston is exposed to the higher pressure.

U.S. Pat. No. 3,036,590 which is also owned by the same corporate entity which owns the subject invention, is directed to an earlier version of a manually operable, ball-type, kelly cock or safety valve.

DISCLOSURE OF THE INVENTION

In accordance with the invention, a valve assembly has been developed which uses a flapper element instead of a ball element and which simplifies fabrication and assembly, reduces the pressure drop across the valve, and prevents undue erosion and wear of the valve element. The valve assembly includes an elongated mandrel sub-assembly which is inserted through the top end of a tubular frame or body and into its lower portion. A hollow piston is mounted in an upper portion of the body and is movable relative to the mandrel sub-assembly, a portion of the piston overlapping and moving along the upper end of the mandrel.

A flapper element is pivotally mounted within the piston and movable between an open position in the piston wall, where the upper end of the mandrel engages and encases the flapper element to hold it open, and a closed position across the opening in the piston, where the mandrel does not engage the flapper element. A spring is provided for urging the flapper element toward its closed position. A helical spring is located in a chamber between the mandrel sub-assembly and the inner wall of the tubular body, which engages the lower end of the piston and urges the piston upwardly toward its normal position where the mandrel does not engage the flapper element and the valve is closed.

During drilling operations the pressure of the circulating drilling mud exerts a downward force against the piston which maintains the piston in its lower position and maintains the valve open. When it becomes desirable to add drill pipe, the drill string must be disconnected from the kelly after the circulation pressure is vented. When this occurs the helical spring will raise the piston and cause the flapper automatically to seat and prevent mud in the kelly from escaping when the joint is uncoupled. If the pressure from below is great enough after the supply pressure is cut off, the internal fluid pressure in the valve will continue to prevent the piston from moving up and closing the valve until the pressure is relieved. When the valve is closed, abnormally high pressure below the flapper can be vented by raising the flapper momentarily until the pressure is vented. When drilling operations are set to continue the supply pressure is turned on which will cause the piston to automatically move down and open the valve.

The structure and shape of the components of such a flapper valve enable the central opening of the valve to be formed with a diameter greater than that in most ball valve assemblies, which operates to minimize the pressure drop across the valve. Furthermore, the flapper valve is totally encased by the mandrel when mud is circulating through the valve which protects it from the abrasive influences of the mud. The overlapping piston and mandrel portions along with the flapper element and power spring can be formed as a cartridge which can easily be inserted as a tubular body for assemblying the valve. In this way expensive drilling mud is prevented from spilling on the rig floor and creating dangerous working conditions.

BRIEF DESCRIPTION OF THE DRAWINGS

The invention will be better understood after the detailed description set forth below is considered in conjunction with the accompanying drawings, in which.

BEST MODE FOR CARRYING OUT THE INVENTION

Figure 1:
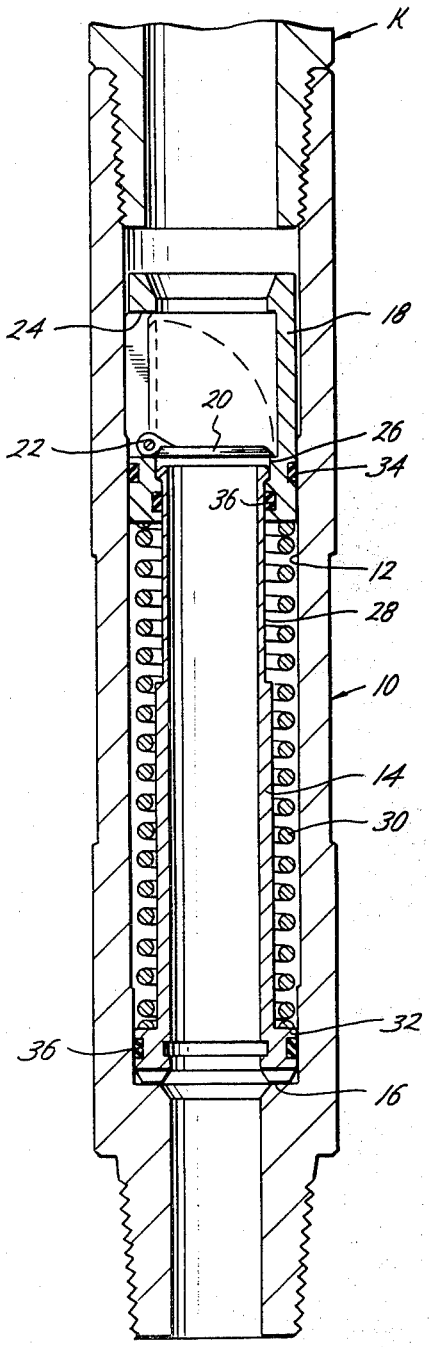
FIG. 1 is a sectional view of the flapper valve assembly where the piston is in its upper position and the flapper element is closed.
Figure 2:
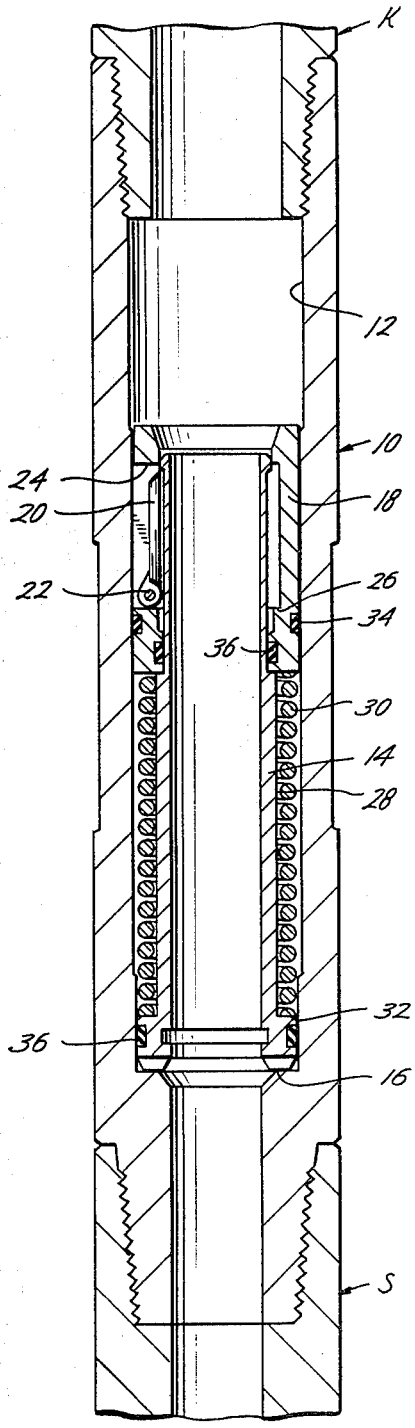
FIG. 2 is a sectional view of the valve assembly of FIG. 1 showing the piston in its lower position, the mandrel engaging the flapper element and holding it open.

The valve assembly, as shown in FIGS. 1 and 2, is mounted in a tubular body 10 which is threaded at both ends for engagement between components such as a kelly K and a length of drill string S which are provided with complementary threads. As described in greater detail below, the assembly is in the form of a cartridge which can easily be inserted into a longitudinal bore 12 which extends through the body 10. The body can be a special sub located directly below a lower kelly valve (not shown) or in a modified saver sub.

The valve assembly includes a stationary mandrel sub-assembly 14 which is mounted in the lower portion of the body 10 on a shoulder 16 formed on the inner surface of body. A hollow piston 18 overlaps the upper end of the mandrel 14 and is movable relative to it between the upper and lower positions respectively shown in FIGS. 1 and 2.

A flapper 20 is pivotally mounted on the piston 18 through a pivot pin 22, the flapper 20 being movable between a lower-closed position depicted in FIG. 1 and an upper-open position depicted in FIG. 2 and shown by the broken lines in FIG. 1. A flapper spring (not shown) located on pivot pin 22 is provided for urging the flapper 20 toward the lower-closed position of FIG. 1. The piston 18 includes a recessed portion 24 in which the flapper 20 can move when it is in its upper-open position. The piston 18 also includes a shoulder 26 which is shaped and dimensioned to engage the flapper 20 in the lower-closed position shown in FIG. 1 and operate as a valve seat.

A chamber 28 is formed between the outer wall of the mandrel 14 and the inner wall of the tubular body 10, a helical power spring 30 being located in the chamber 28 between a shoulder 32 on the mandrel 14 and the lower end of the piston 18. The power spring 30 operates to urge the piston 18 upwardly so that when the valve assembly is in its normal position the piston 18 and flapper 20 will be positioned as shown in FIG. 1, closing the valve.

Whenever the mud supply pressure is on, the downward force exerted on the enlarged upper annular surfaces of the piston 18 will be sufficient to overcome the force of the power spring 30, and cause the piston to move to the position shown in FIG. 2, the upper end of the mandrel 14 engaging the flapper 20 first at the farthest point from the hinge pin and operating as a cam to overcome the force of the flapper spring and move the flapper 20 to the open position shown in FIG. 2. As can be seen in FIG. 2, the mandrel 14 totally encases the flapper 20 so that circulation of abrasive drilling fluid is prevented from coming in contact with the flapper 20. When the supply pressure is cut off, the power spring will provide sufficient force to automatically raise the piston 18 back to the position shown in FIG. 1 so that the flapper spring will automatically close the flapper 20. The flapper is made of two piece construction (an outer frame encompasses a frangible disc). The disc can be knocked out and provides full bore hole for any wireline tools. If after the supply pressure is cut off the drill line pressure remains abnormally high the valve will remain open until the pressure is relieved. A visual indicator of such a condition (not shown) can be provided as taught in U.S. Pat. No. 3,743,015 (see col. 3, lns. 56–67; col. 4 lns. 1–9). Further, when the flapper 20 is in the position shown in FIG. 1, any unbalanced pressure below the flapper 20 sufficient to overcome the force of the flapper spring will cause the flapper 20 to raise upwardly and vent that pressure, the valve automatically closing after the pressure is relieved.

In order to insure the fluid-tight seal of the valve assembly, appropriate seals 32, 34 and 36 formed of rubber or other resilient material are respectively provided between the piston and mandrel and the tubular body and between the mandrel and piston. Cooperating shoulders 40 and 42 located on the mandrel and piston, respectively, limit upward movement of the piston 18 as shown in FIG. 1. Openings or ports (not shown) can be provided in the wall of the tubular body to communicate the chamber 28 with the atmosphere for creating a greater differential pressure across the piston 18 as more fully described in U.S. Pat. No. 3,743,015 (see col. 3, lns. 35–55).

Assembly of the valve is a relatively easy operation since all the internal elements described above can be assembled as a unitary cartridge and simply inserted downwardly through the upper opening of the tubular body 10. The shoulder 16 will engage the lower end of the mandrel and hold the cartridge in place.

As can be seen from the foregoing description, the valve assembly is formed of components having a configuration such that the valve opening can have a diameter significantly greater than that of ball valves which have heretofore been used, reducing the pressure drop across the valve. The valve element itself is protected from the abrasive influence of circulating mud when the valve is open which increases valve life and insures more effective performance. Furthermore, the flapper valve provides a built-in safety feature of allowing unbalanced pressure below the valve to be vented when the valve is closed.

The foregoing disclosure and description of the invention are illustrative and explanatory thereof, and various changes in the size, shape and materials as well as in the details of the illustrated construction may be made without departing from the spirit of the invention.

We claim:

1. A valve assembly for preventing a column of drilling fluid from spilling out of the lower end of a kelly, comprising an elongated body which has an axial opening and is threaded at both ends, a cam rigidly mounted in the bore, a hollow piston in the opening and mounted for axial movement relative to the cam, the piston being shaped so that fluid pressure in the body will exert a downward force on the piston, a valve element pivotally mounted in the piston, the piston inner surface defining a valve seat, the valve element being movable between a lower-closed position when the valve element is above the cam and engages the seat to an upper-open position where the cam engages the valve element and holds it away from the seat, spring means for urging the valve element toward the closed position, means for urging the piston upwardly in the bore so that the valve element is normally in its closed position, and whereby when a sufficient downward force caused by fluid pressure in the body is applied to the piston to overcome the upward force of the urging means the piston will move down causing the cam to engage and raise the valve element to its open position, the piston moving upwardly and the valve element returning to its closed position when the downward force is removed.

2. The valve assembly of claim 1, wherein the cam includes an elongated mandrel element, the upper end of the mandrel operating as a cam surface.

3. The valve assembly of claim 2, wherein the piston overlaps the upper end of the mandrel.

4. The valve assembly of claim 3, wherein the mandrel is spaced from the wall defining the bore, forming a chamber therebetween, and the urging means includes a helical spring in the chamber which engages the mandrel at one end and the lower end of the piston at the other end.

5. The valve assembly of claim 2, wherein the mandrel totally encases the valve element when the latter is in its upper-open position for protection against circulating drilling fluid.

6. The valve assembly of claim 1, wherein the valve element includes a flapper.

7. The valve assembly of claim 6, wherein the inner wall of the piston includes a recess to receive the flapper in its upper-open position.

8. The valve assembly of claim 1, wherein the cam and piston are hollow, tubular members which overlap each other and a coil spring therebetween formed as a unit for insertion downwardly in the opening.

9. A valve assembly cartridge adapted for easy insertion in the opening of an elongated body and operating to prevent a column of drilling fluid from spilling out of the lower end of a kelly, the cartridge including an elongated tubular mounted element with an upper cam surface, a hollow piston overlapping the upper end of the mandrel and wholly movable relative thereto, a coil spring around the outer surface of the mandrel engaging the lower end of the piston urging the piston upwardly relative to the mandrel, a flapper element pivotally mounted in the piston movable between an upper-open position and a lower-closed position against a valve seat formed in the piston, spring means for urging the flapper element toward the closed position, the cam surface and piston cooperating so that when a sufficient downward force is applied to the piston it will move downwardly relative to the cam surface which will, in turn, engage and move the flapper element toward the open position, the piston and flapper element returning to their upper and closed position, respectively, when the force is removed.

* * * * *